United States Patent [19]

Carmel et al.

[11] 4,379,977

[45] Apr. 12, 1983

[54] SPACE-DISCHARGE ELECTRONIC DEVICE PARTICULARLY USEFUL AS A FLASH X-RAY TUBE

[75] Inventors: Yuval Carmel; Shmuel Eylon, both of Haifa, Israel

[73] Assignee: State of Israel, Rafael Armament Development Authority, Ministry of Defense, Haifa, Israel

[21] Appl. No.: 262,886

[22] Filed: May 13, 1981

Related U.S. Application Data

[63] Continuation of Ser. No. 62,476, Jul. 31, 1979, abandoned.

[51] Int. Cl.[3] ..... H01J 35/04

[52] U.S. Cl. ..... 378/136; 378/140

[58] Field of Search ..... 313/55, 56

[56] References Cited

U.S. PATENT DOCUMENTS 3,883,760 5/1975 Cunningham ..... 313/55 X 3,970,884 7/1976 Golden ..... 313/55

*Primary Examiner*—David C. Nelms

*Assistant Examiner*—Darwin R. Hostetter

*Attorney, Agent, or Firm*—Benjamin J. Barish

[57] ABSTRACT

A space-discharge electronic device is described, particularly useful as a flash X-ray tube, which device includes a cathode of planar shape and formed with a circular opening therethrough, and a target anode of conical shape and having a pointed tip at the end facing the cathode, the longitudinal axis of the target anode being normal to the plane of the cathode. The pointed tip of the target anode is located in the plane of the planar cathode at the center of its circular opening. When used as a flash X-ray tube, the target anode is made of a material which emits X-rays when impinged by the electrons from the cathode.

7 Claims, 4 Drawing Figures

SPACE-DISCHARGE ELECTRONIC DEVICE PARTICULARLY USEFUL AS A FLASH X-RAY TUBE

This application is a continuation of Ser. No. 62,476, filed 7/31/79 now abandoned.

BACKGROUND OF THE INVENTION

The present invention relates to space-discharge electronic devices. The invention is particularly useful in flash X-ray tubes, and is therefore described below with respect to this application.

Flash X-ray tubes are used in radiography for the study of high-speed transient phenomena of opaque media or luminous object in such fields as ballistics, shock waves and medicine. In such applications, it is particularly desirable to have a small size X-ray source to enable high-quality, low penumbera radiographs to be taken at small source-to-object distances. It is also desirable that the X-ray tube be of a design which minimizes or eliminates the need for heavy tube protection against fragments and shocks.

OBJECTS AND THE SUMMARY OF THE PRESENT INVENTION

An object of the present invention is to provide an improved space-discharge electronic device having a cathode-anode configuration producing an electrostatic field which focusses the electrons emitted by the cathode to a very small spot on the anode.

By utilizing an X-ray emitting material for the anode, the device may be used as a flash X-ray tube generating X-rays of very small spot size.

Another object of the invention is to provide a flash X-ray tube of a design which eliminates the need for heavy tube protection against fragments and shocks.

The flash X-ray tube of the present invention thus produces an appreciable increase in the X-ray flux at the film because of the small source-to-object distance enabled by the small size X-ray source, and because of the absence of protection materials against fragments and shocks.

A further object of the invention is to provide a flash X-ray of a construction which may be made inexpensively so as to be expendable, and which uses common machinery available in laboratory workshops thus eliminating the need for specialized high-temperatured, high-vacuum glass sealing techniques.

According to a broad aspect of the present invention, therefore, there is provided a space-discharge electronic tube including a cathode and a target anode, characterized in that the cathode consists of a planar metal electrode formed with a circular, opening therethrough, and that said target anode is of conical shape and has a pointed tip at the end thereof facing said cathode; the longitudinal axis of the target anode being normal to the plane of the cathode. The pointed tip of the target anode is located in the plane of the planar cathode at the center; of its circular opening.

Particularly good results are obtained when the circular opening formed through the cathode is bounded by an annular sharp edge.

As indicated above, the device may be used as a small-size X-ray source by utilizing an X-ray emitting material for the target anode.

According to a further feature included in the described embodiment of the invention, the tube includes a metal housing having an exit window for the X-rays at the cathode end of the housing, and a pumping port for continuously evacuating the housing. Such a construction enables the tube to be made inexpensively so as to be expendable, and avoids the need for specialized high-temperature high-vacuum glass sealing techniques.

While the invention is particularly useful as a small-size X-ray source, it may be used in other applications, such as electric are heaters, requiring the focusing of the electrons emitted by the cathode onto a very small spot on the target anode.

Further features and advantages of the invention will be apparent from the description below.

BRIEF DESCRIPTION OF THE DRAWINGS

The invention is described herein, by way of example only, with reference to the accompanying drawings, wherein:

FIG. 2 is an enlarged fragmentary view illustrating the construction and inter-relationship of the target anode and the cathode in the tube of FIG. 1;

FIG. 3 illustrates characteristic wave forms of (a) voltage, (b) current, and (c) X-ray intensity of the flash X-ray tube of FIG. 1; and FIG. 4 illustrates the X-ray duration (at the 50% points) with fluctuations in (a) anode-cathode separation, and (b) Marx generator changing voltage in the flash X-ray tube of FIG. 1.

DESCRIPTION OF THE PREFERRED EMBODIMENT

Figure 1:
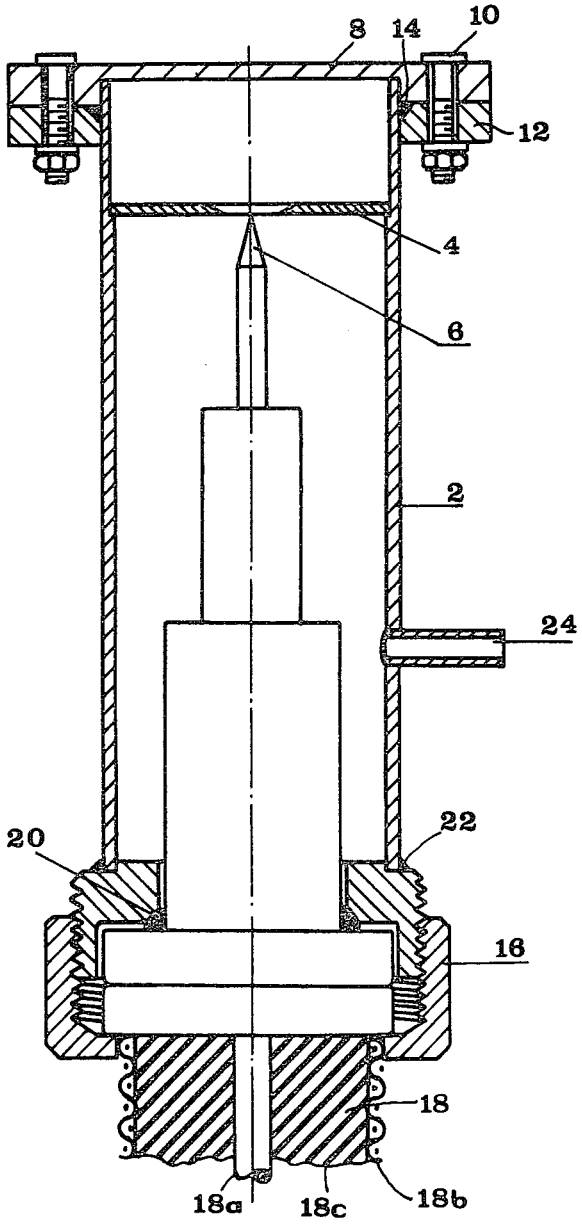
FIG. 1 is a longitudinal sectional view illustrating one form of a flash X-ray tube constructed in accordance with the invention.

The flash X-ray tube illustrated in FIG. 1 comprises an outer metal enclosure or housing 2 of cylindrical shape enclosing the cathode 4 and the target anode 6 of the tube. The cathode end of the housing is closed by an exit window 8 attached by fasteners 10 to an annular ring 12 secured to the metal housing 2, there being a vacuum seal 14 between the housing and exit window 8. The opposite end of the housing includes a coaxial connector 16 for connecting the cathode 4 and anode 6 to the conductors of a coaxial cable 18.

More particularly, the inner conductor **18*a* of the coaxial cable 18 is connected to the target anode 6, and the outer conductor 18*b* of the coaxial cable is connected via connector 16 to the metal housing 2. The connector 16 includes vacuum seals 20 and 22 between same and the coaxial cable 18 and the metal housing 2**, respectively.

The coaxial cable 18 may be a 70-ohm flexible coaxial transmission line including an inner conductor **18*a*, an outer metal braid 18*b* constituting the outer conductor, and solid flexible insulation 18*c*** between the inner and outer conductors. This arrangement permits positioning of the tube close to the radiographed object and away from the tube electrical driving generator. It also enables the parallel connection of several tubes to a single driving generator.

The metal housing 2 includes a pumping port 24 connected to vacuum-applying means (not shown) for continuously evacuating the housing, for example to a base pressure of $10^{-4}$ Torr.

The construction and inter-relationship of the cathode 4 and the target anode 6 are more particularly illustrated in the enlarged view of FIG. 2. It will be seen that the cathode 4 is of a planar shape and is formed with a central circular opening 30 bounded by an annular sharp edge 32. The target anode 6 is of conical shape and has a pointed tip 34 at its end facing the cathode 4. As can also be seen in FIG. 2, the logitudinal axis of the target anode 6 is normal to the plane of the cathode 4 and is aligned with the center of its circular opening 30.

In the arrangement illustrated in FIGS. 1 and 2, the target anode 6 is located with its pointed tip 34 in the plane of the cathode 4. This has been found to produce an electrostatic field between the cathode and anode which focusses the electrons emitted from the cathode to a fine spot on the pointed tip of the anode, thus causing same to act as a relatively small size point source of X-rays.

Preferably the angle of the conical target anode may be from 15° to 30°, an angle of 30° having been found to produce particularly good results.

For purposes of example, the cathode 4 may be of stainless steel metal, the target anode 6 may be of tungsten, and the exit window 8 may be plastic, such as methyl methacrylate. The flash X-ray tube illustrated in FIGS. 1 and 2 may be driven by a 200kV 0.6 GW electrical pulse generator, to produce a radiation source (0.5 mm in size) of 20 ns in duration.

The quality of a flash radiographic image is dependent on the following design parameters.

(a) The X-ray source size. The radiographed object is surrounded by a penumbra area, the width of which is given by $P_s=(b/a)s$, where s is the source size, a the object-to-source distance, and b the film to object distance.

(b) Motion blur. The blur $P_m$, under the assumption of a point X-ray source, can be expressed as $P_m=V\tau(a+b)/a$, where $V\tau$ is the distance covered by an object moving with a velocity V during the duration of the X-ray pluse $\tau$.

(c) The driving voltage. Optimun contrast is obtained when the criterion $\mu d=1$ is satisfied, where d is the object thickness and $\mu$ is the X-ray absorption coefficient. It is necessary to adapt the hardness of the X-ray radiation to the thickness of the object under observation.

Usually in applications such as ballistics investigations a typical object velocity is up to 5 mm/$\mu$s, object-to-film distance is 0.5 m, and the object-to-source distance is 1 m. When using a flash X-ray tube with a 0.5 mm X-ray source and a 20 ns radiation pulse duration, a penumbra $P_s$ of 0.25 mm and motion blur of 0.15 mm is obtained. For comparison a typical resolution of a film and intensifier combination is 0.25 mm. The system is commonly used in the shadowgraph mode. However, in internal radiographic applications, the image quality is determined by the hardness of the incident radiation as well as the thickness and the nature of the object material. For a typical material as aluminum with $\mu=0.48$ $cm^{-1}$ at 100 kV, the optimum condition $\mu d=1$ is obtained for a penetration of 2 cm.

FIG. 3 illustrated in graphs (a), (b), and (c), respectively, the voltage, current and X-ray wave forms produced by the flash X-ray tube of FIGS. 1 and 2*a*. FIG. 4 illustrates the X-ray duration in the operation of the above-described tube at the 50% points, graph (a) showing the X-ray duration as a function of anode-cathode separation at 30 kV Marx charging voltage, and graph (b) showing the X-ray duration as a function of Marx generator charging voltage.

The performance of the flash X-ray tube of FIGS. 1 and 2*a* as illustrated by the graphs in FIGS. 3 and 4 was obtained in the following manner:

The flash X-ray tube was connected to a five stage Marx generator through the 70-Ω coaxial cable 18. Several diagnostic methods were used simultaneously to evaluate the radiating and electrical performance of the flash X-ray tube.

The tube current was measured using a Rogowski current monitor placed between the coaxial cable braid 18*b* and the inner conductor 18*a* and integrated in the connector. A voltage divider composed of a series of carbon resistors, mounted around the inner conductor insulator 18*c*, was used to measure the tube voltage wave form. A photomultiplier -- scintillator combination was used to measure the X-ray radiation time dependence. The diameter of the X-ray source was measured using a 0.5 mm pinhole camera. A cold cathode ion gauge was used to monitor the pressure.

The anode tip was placed at the center of the cathode plane as shown in FIG. 2*a*. An equivalent (FWHM) 0.5 mm source size was measured while operating the tube at 200 kV and a base pressure of $10^{-4}$ Torr. Voltage, current, and X-ray intensity wave forms were measured at the above operating conditions, and are shown in FIGS. 3(*a*), and 3(*b*), and 3(*c*), respectively.

During the operation of the tube, the plasma which is generated due to target evaporation propagates towards the cathode. When the plasma reaches the cathode the tube is shorted and radiation decreases, thus terminating the X-ray pulse. This phenomenon is affected by the tube voltage and electrode separation as described in FIGS. 4(*a*) and 4(*b*). Analyzing the data presented in FIG. 4, one can deduce a plasma propagating velocity of 10 mm/$\mu$s assuming a constant plasma velocity.

The operating parameters are summarized in the following table.

| Flash X-Ray Tube Operating Parameters | | |
|---|---|---|
| Dose per pulse at 0.25 m | [mR] | 5 |
| Dose rate at exit port | [R/s] | $5 \times 10^7$ |
| Radiation pulse duration (at 50% points) | [ns] | 20 |
| Source diameter (at 50% film density level on an image) | [mm] | 0.5 |
| Operating voltage | [kV] | 200 |
| current | [kA] | 2.5 |
| pressure | [Torr] | $10^{-4}$ |
| Penetration (Cu at 1 m) | [mm] | 6 |

While the flash X-ray tube described above represents a preferred embodiment of the invention, it will be appreciated that the invention could also be used in other applications requiring the focussing of electrons from a cathode onto a very samll spot on the target anode. One such other application might be an electrical-arc heater, in which the impingement of the focussed electrons onto the target anode generates heat. In such an application, the target anode may be a consumable-type electrode, e.g., periodically-replaceable conical tips applied to the free end of the anode.

Many other variations, modifications and applications of the invention may be made.

What is claimed is:

1. A space-discharge electronic tube including a cathode and a target anode, characterized in that said cathode consists of a single planar electrode formed with a circular opening therethrough, and that said target anode is of conical shape and has a pointed tip at the end thereof facing said planar cathode electrode, the longitudinal axis of the target anode being normal to the plane of said planar cathode electrode and the pointed tip of the target anode being located in the plane of said planar cathode electrode at the center of its circular opening.

2. A tube according to claim 1, wherein the circular opening formed through the planar cathode electrode is bounded by an annular sharp edge.

3. A tube according to claim 1, wherein the target anode is in the form of an approximately 15° to 30° cone.

4. A tube according to claim 1, wherein said target anode is of a material which emits X-rays when impinged by the electrons from the planar cathode electrode.

5. A tube according to claim 4, further including a housing having an exit window for the X-rays at the planar cathode electrode end thereof, and a pumping port for continuously evacuating the housing.

6. A tube according to claim 5, wherein said housing is of metal and is electrically connected to said planar cathode electrode.

7. A tube according to claim 1, further including a coaxial connector at the end of the housing opposite to that of the planar cathode electrode for connecting the metal housing to the outer conductor of a coaxial cable, and the target anode to the inner conductor of the coaxial cable.

* * * * *